United States Patent [19]

Coombe

[11] Patent Number: 4,502,641

[45] Date of Patent: Mar. 5, 1985

[54] FLUID ENERGY MILL WITH DIFFERENTIAL PRESSURE MEANS

[75] Inventor: Anthony J. Coombe, McEwen, Tenn.

[73] Assignee: E. I. Du Pont de Nemours and Company, Wilmington, Del.

[21] Appl. No.: 258,872

[22] Filed: Apr. 29, 1981

[51] Int. Cl.[3] ..... B02C 19/12

[52] U.S. Cl. ..... 241/5; 241/39

[58] Field of Search ..... 241/33, 34, 5, 39, 30

[56] References Cited

U.S. PATENT DOCUMENTS

| | | | |
|---|---|---|---|
| 2,032,827 | 3/1936 | Andrews | 83/46 |
| 2,783,947 | 3/1957 | Hage | 241/34 |
| 2,783,948 | 3/1957 | Hage | 241/34 |
| 3,380,665 | 4/1968 | Jester et al. | 241/5 |
| 3,462,086 | 8/1969 | Bertrand et al. | 241/5 |
| 3,726,484 | 4/1973 | Schurr | 241/5 |

*Primary Examiner*—Mark Rosenbaum

[57] ABSTRACT

A fluid energy mill of the confined vortex type for comminuting pulverulent solids, said mill provided with means for measuring the differential pressure between the discharge and the feed of the mill through openings in the chamber peripheral wall and in the discharge means, each opening provided with means for purging into the mill to prevent pluggage thereof and a process for using the mill to grind solid $TiO_2$ by maintaining a constant differential pressure between 100–600 inches of water.

5 Claims, 2 Drawing Figures

FLUID ENERGY MILL WITH DIFFERENTIAL PRESSURE MEANS

DESCRIPTION

1. Technical Field

The present invention relates to a fluid energy mill of the confined vortex type with a means for measuring the differential pressure across the mill and a process for grinding particulate $TiO_2$ with the aforesaid energy mill to achieve $TiO_2$ with improved gloss with efficient utilization of energy.

2. Background Art

Fluid energy mills of the confined vortex type are known and employed in industries such as pigment, cosmetic and plastic because of their efficiency and economy in comminuting particulate solids. U.S. Pat. No. 2,032,827 discloses designs of such mills in detail.

Generally a fluid energy mill of a confined vortex type is disclosed in U.S. Pat. No. 3,462,086 as a variation of a basic disc-shaped chamber enclosed by two generally parallel circular plates defining axial walls with an annular rim defining a peripheral wall. The height of the chamber axially being substantially less than the diameter. Around the circumference of the peripheral wall are located a number of uniformly spaced jets for injecting a fluid, which furnishes the energy for comminution and one or more inlets for feeding the particulate solids to be comminuted. The fluid and the particulate solids are injected tangentially to the circumference of a circle that is smaller than the chamber circumference. A coaxial conduit in direct communication with the grinding chamber is provided as a discharge means for the comminuted solids. In U.S. Pat. No. 3,726,484 paraxially symmetrical discontinuities projecting from the axial walls of the chamber prevents the discharge of oversized particles before they are reduced to the desired size.

The flow of particulate solids to the mill has been controlled so as to permit efficient grinding of the solids. Fluid energy mills combine grinding and classification in a single chamber. As the fluid is fed tangentially into the periphery of the chamber along with solids to be comminuted, a vortex is created whereby the particles are swept along a spiral path to be eventually discharged at the outlet. Generally the fluid feed rate is maintained constant. Efficiency of grinding and quality of the product where $TiO_2$ is being ground are affected by the ratio of the fluid feed rate to the particulate solids feed rate.

Generally in the case of $TiO_2$ the flow of solids tends to be irregular when flow meters are used due to pigment buildup in the equipment for flow measurement as well as buildup in the feed chute where measurements are taken. Thus, solid feed rates can unknowingly be variable. This variability can result in inefficient energy use and substandard product. The variability can have the same adverse effect on $TiO_2$ grinding even where the flow meter is used to control the feed rate of $TiO_2$ to the fluid energy mill.

DISCLOSURE OF THE INVENTION

Now an apparatus has been discovered that avoids the adverse effects of the prior art and permits a more efficient use of fluid energy for grinding and provides an improved quality of product. The present apparatus is an improvement in the apparatus of the prior art.

Accordingly, it has now been found that in a fluid energy mill of the confined vortex type for comminuting pulverulent solids having in combination a disc-shaped chamber defined by a pair of opposing circular-shaped axial walls and a peripheral wall, a multiplicity of inlets extending through the peripheral wall and aligned for directing gaseous fluid into the chamber tangentially to a circle whose radius is smaller than the radius, $R_1$ of the chamber, means for charging pulverulent solids to the chamber at the peripheral wall and discharge means for withdrawing pulverulent solids and gaseous fluid along the axis of the chamber, the improvement wherein the fluid energy mill is provided with means for measuring the differential pressure between the discharge and feed of the mill through openings in the chamber peripheral wall and in the discharge means, each opening provided with a means for purging into the mill to prevent pluggage.

Furthermore, it was found that the grinding of $TiO_2$ pigment particles by feeding said particles into a fluid energy mill at a rate that will maintain a constant differential pressure within the fluid energy mill of from 100–600 inches of water resulted in advantages over prior known methods.

In the case where superheated steam is the fluid energy that is fed to a fluid energy mill, the steam pressure is converted to velocitv as the steam expands in the jets and nozzles. The jets and nozzles are positioned around the grinding chamber in such a way that the steam jets force the steam and solid particulate to move in a vortex within the chamber. The speed at which the steam and particulate solids travel around the chamber is the tangential velocity.

The tangential velocity decreases when the particulate solids are introduced into the steam because the solids are accelerated at the expense of the kinetic energy of the steam. The greater the solids feed rate the greater the reduction in tangential velocity. Tangential velocity is further reduced by the additional friction in the case where the solids are more difficult to grind and are therefore retained in the grinding chamber longer. Tangential velocity is therefore a function of steam flow, pigment feed rate and pigment grindability.

Grinding energy in the field of pigments has traditionally been defined as the ratio of steam flow to solid pigment feed rate (S/P) for fluid energy mills. From the preceding discussion it is evident that tangential velocity is directly proportional to steam flow and inversely proportional to the pigment feed rate, hence a direct measure of grinding energy. Although tangential velocity cannot be measured directly, the differential pressure between the grinding chamber periphery and gas outlet can be measured and is, in fact, a function of tangential velocity. Differential pressure therefore defines the grinding energy.

Control of differential pressure permits control of grinding energy, which in turn controls product quality. In controlling differential pressure, pigment feed rate is chosen as the manipulated variable. Pigment feed is chosen because of difficulties in measuring it directly, and because at constant steam rate where production is maximized, the differential pressure becomes primarily a function of pigment feed. The speed of the pigment feeder is adjusted to maintain a constant $\Delta P$. The control action is inverse to the pigment feed since the differential pressure is inversely proportional to the pigment feed rate. As differential pressure increases, additional feed is provided by speeding up the feed of solids. The increased feed rate decreases ΔP. Likewise, a drop in ΔP would require a decrease in the feed of solids in order to increase ΔP to the desired level. The feed rate can be manually changed or can be automatically adjusted.

As pointed out previously, differential pressure responds to changes in pigment grindability. If a pigment becomes more difficult to grind, for whatever reason, the differential pressure will be depressed and therefore require a reduction in the feed of solids to the mill. This occurrence of more difficult to grind solids heretofore would pass unknown through the mill with the result that the particle size of the product would be too large and the gloss of the $TiO_2$ pigment would be too low. Now for the first time the drop in ΔP can be used to avoid this decrease or loss in gloss. A drop in ΔP is a warning that the pigment particles require more grinding and therefore must be retained in the mill longer to reach the required particle size. The ability to make corrections in feed rate based on ΔP therefore offers an advantage over prior known operations in the achievement of a uniform quality product.

Additionally, control of solids feed rate with ΔP is more reliable than a manual control of solids that is based on a direct measurement of the solids flow rate. Flow meters tend to be inaccurate. They are subject to drift, plugging, fouling, etc. The pressure taps of this invention may also plug but the probability of pluggage is less. This is due to the maintaining of a constant purge flow through the tap lines. If, however, there is a plugging of the pressure tap lines, it will be apparent immediately. Corrective measures can be taken immediately to assure uniform quality of product. The grinding of the present process also permits a $TiO_2$ reduction in grinding energy of about 5–10% over that required heretofore.

The novel feature of the apparatus of the invention and the use of said apparatus to grind $TiO_2$ pigment is the concept of relating differential pressure to feed rate and the control of feed rate to provide constant ΔP across the mill.

DETAILED DESCRIPTION OF THE DRAWINGS

The invention will be further described with reference to the drawings.

Figure 1:
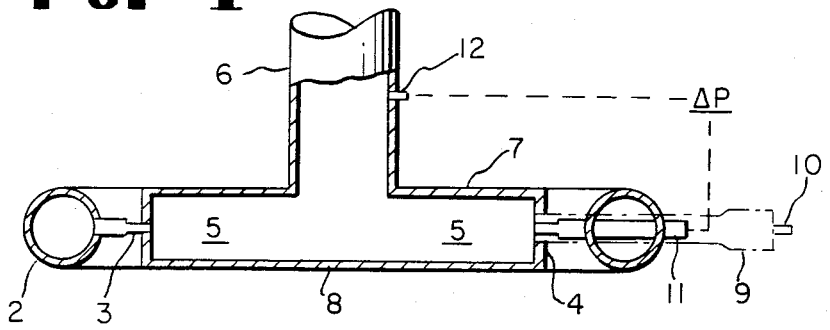
FIG. 1 is a vertical cross section of the apparatus of the invention.
Figure 2:
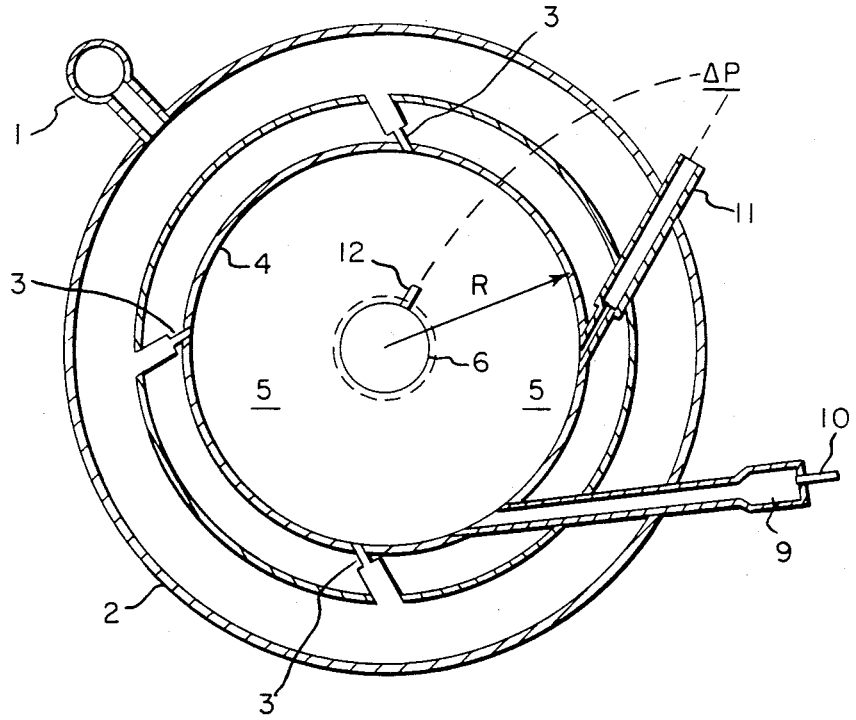
FIG. 2 is a horizontal cross section of the apparatus of FIG. 1 normal to the axis at the inlet jet level.

Referring now to FIG. 1 and FIG. 2, 1 is a source of fluid, which in the case of superheated steam has temperature and pressure controlling capabilities. The preferred fluid is superheated steam. A fluid header 2 encircles the peripheral wall 4 of circular grinding chamber 5. Nozzles 3, of which only three are shown, interconnect the header and the grinding chamber. Each nozzle 3 enters the peripheral wall 4 of the chamber at an angle such that the extension of the nozzle axis is tangent to a circle about the center of the chamber which has a radius smaller than the radius, R, of the chamber. A multiplicity of these nozzles is advantageously used. The chamber 5 is shown to be relatively disc shaped, its actual dimensions being determined by the upper and lower circular plates 7 and 8 and peripheral wall 4. A venturi feeding device 9 serves to introduce the solid material to be ground to the chamber, it being aligned somewhat tangentially to facilitate flow of the solids and fluid into the chamber vortex. The fluid is introduced to the venturi by nozzle 10 and serves to entrain and carry solids into the grinding chamber. The cylindrical discharge opening 6 carries fluid and ground solids out of the grinding chamber. Pressure tap line 12 senses the pressure in the discharge opening. Pressure tap line 11 senses the pressure at the periphery of the grinding chamber. The ΔP is the differential pressure across the mill. Purges with a non-condensable fluid are applied to each pressure tap line to prevent pluggage thereof. The ΔP is maintained at the desired value by adjusting the feed of solid material into the mill.

The process of the present invention comprises feeding solid particulate $TiO_2$ particles to the fluid energy mill described above. The fluid of the present process is superheated steam. The flow of $TiO_2$ solids to the mill may be delivered by any of many known means, e.g., belt feeder, screw feeder, pneumatic feeder, etc. The means for solids delivery are not critical. The feed rate, however, must be adjustable. The process of the present invention therefore comprises controlling the flow of $TiO_2$ solids and/or the flow of superheated steam to provide a constant ΔP across the mill. However, it is preferred to control the flow of $TiO_2$ solids and not the superheated steam flow so that production can be maximized.

The ΔP across the mill must be held constant at a pressure value of from 100–600 inches of water depending on the degree of comminuting of the $TiO_2$ solids. The particular ΔP at which the process can be operated depends on the specific use for which the $TiO_2$ is intended, the gloss or particle size required and the geometry and size of the mill. Accordingly, therefore, the ΔP for some $TiO_2$ applications is 250–375 inches of water and 300–400 inches of water for others and 350–450 inches of water for still others.

The apparatus of the present invention permits grinding of particulate solids more efficiently. Apparatus of the prior art do not effectively provide as uniform a grind of solids and at as low steam to pigment ratios, e.g., a reduction of at least 5% in energy.

The process of the present invention permits the grinding of $TiO_2$ more efficiently and provides for the preparation of $TiO_2$ having less of the larger more difficult to grind particles which results in improved gloss as well as more uniform gloss. The process also provides a more efficient use of energy, e.g., a reduction of at least 5% in energy as compared to conventional fluid energy mills.

The description of the fluid energy mills described in U.S. Pat. Nos. 3,462,086 and 3,726,484 are hereby incorporated herein by reference.

I claim:

1. In a fluid energy mill of the confined vortex type for comminuting pulverulent solids having in combination a disc-shaped chamber defined by a pair of opposing circular-shaped axial walls and a peripheral wall, a multiplicity of inlets extending through the peripheral wall and aligned for directing gaseous fluid into the chamber tangentially to a circle whose radius is smaller than the radius, R, of the chamber, means for charging pulverulent solids to the chamber at the peripheral wall and discharge means for withdrawing pulverulent solids and gaseous fluid along the axis of the chamber, the improvement wherein the fluid energy mill is provided with means for measuring the differential pressure between the discharge and feed of the mill through openings in the chamber peripheral wall and in the discharge means each opening provided with a means for purging into the mill to prevent pluggage.

2. A method of grinding $TiO_2$ pigment solids by feeding said solids into a fluid energy mill of a confined vortex type at a rate that will maintain a constant differential pressure across the fluid energy mill that is within the range of 100–600 inches of water.

3. The method of claim 2 wherein the differential pressure is 250–375.

4. The method of claim 2 wherein the differential pressure is 300–400.

5. The method of claim 2 wherein the differential pressure is 350–450.

* * * * *